US006539175B1

(12) United States Patent
Geary et al.

(10) Patent No.: US 6,539,175 B1
(45) Date of Patent: Mar. 25, 2003

(54) HIGHWAY CRASH BARRIER MONITORING SYSTEM

(75) Inventors: Jeffrey A. Geary, Normalville, PA (US); David A. Smith, Smithfield, PA (US)

(73) Assignee: Energy Absorption Systems, Inc., Chicago, IL (US)

( * ) Notice: Subject to any disclaimer, the term of this patent is extended or adjusted under 35 U.S.C. 154(b) by 34 days.

(21) Appl. No.: 09/606,944

(22) Filed: Jun. 29, 2000

(51) Int. Cl.[7] ..... G03B 17/00
(52) U.S. Cl. ..... 396/59; 404/6
(58) Field of Search ..... 404/6; 396/59, 396/502

(56) References Cited

U.S. PATENT DOCUMENTS

| | | | | |
|---|---|---|---|---|
| 3,478,311 A | | 11/1969 | Czingula | |
| 3,807,699 A | | 4/1974 | France | |
| 4,674,911 A | | 6/1987 | Gertz | |
| 4,681,302 A | | 7/1987 | Thompson | |
| 4,734,725 A | * | 3/1988 | Bierman | 396/59 |
| 4,934,661 A | | 6/1990 | Denman et al. | |
| 5,022,782 A | | 6/1991 | Gertz et al. | |
| 5,112,028 A | | 5/1992 | Laturner | |
| 5,262,813 A | * | 11/1993 | Scharton | 396/502 |
| 5,314,261 A | | 5/1994 | Stephens | |
| 5,425,594 A | | 6/1995 | Krage et al. | |
| 5,485,140 A | | 1/1996 | Bussin | |
| 5,623,248 A | | 4/1997 | Min | |
| 5,624,203 A | * | 4/1997 | Jackson et al. | 404/6 |
| 5,642,792 A | | 7/1997 | June | |
| 5,733,062 A | | 3/1998 | Oberth et al. | |
| 5,797,591 A | | 8/1998 | Krage | |
| 5,797,592 A | | 8/1998 | Machado | |
| 5,829,913 A | * | 11/1998 | Puckett | 404/6 |
| 5,967,497 A | | 10/1999 | Denman et al. | |

OTHER PUBLICATIONS

"Cellemetry," Cellemetry website, pp. 1–3, Jun. 2000.
Cellemetry schematic illustration, date unknown.

* cited by examiner

*Primary Examiner*—Russell Adams
*Assistant Examiner*—Michelle Nguyen
(74) *Attorney, Agent, or Firm*—Brinks Hofer Gilson & Lione

(57) ABSTRACT

A highway crash barrier includes a collision sensor that detects when a vehicle collides with the crash barrier. A transmitter is coupled with the collision sensor to transmit a radio frequency signal to a remote location when this collision sensor detects a collision. This radio frequency signal includes a fault message that is forwarded automatically to a user responsible for maintenance of the crash barrier. A camera is controlled in response to the collision sensor to store an image of the crash barrier shortly after the collision.

19 Claims, 4 Drawing Sheets

Microfiche Appendix Included
(2 Microfiche, 190 Pages)

HIGHWAY CRASH BARRIER MONITORING SYSTEM

REFERENCE TO MICROFICHE APPENDIX

This specification includes a microfiche appendix including 2 sheets of microfiche and a total of 190 frames. This microfiche appendix includes copyrighted subject matter. The owner of the copyright reserves all copyright rights whatsoever, other than the right to reproduce the microfiche appendix in facsimile form as a part of this specification.

BACKGROUND

The present invention relates to highway crash barriers, and in particular to systems for remotely reporting a collision of a vehicle with a crash barrier.

Highway crash barriers are commonly positioned alongside a roadway to protect occupants in a vehicle that has left the roadway. Such crash barriers often include an energy absorbing system that protects the vehicle occupants against high decelerations in a collision.

Once a collision has occurred between a vehicle and a highway crash barrier, the crash barrier is often damaged. It is important that damaged crash barriers be repaired or replaced promptly to minimize instances in which a second collision occurs with a damaged crash barrier. Such a second collision can expose the colliding vehicle to increase risks.

In the past, it has been common practice for highway departments to inspect installed highway crash barriers on a regular basis to determine whether repairs or replacements are needed. This approach is expensive, because it requires an inspector to travel to the site of the highway crash barrier. Also, this approach provides the disadvantage that a considerable time period may elapse between the time a crash barrier is damaged in a collision and the time of the next inspection.

The present invention is directed to an improved highway crash barrier monitoring system that substantially overcomes these problems of the prior art.

BRIEF SUMMARY

The monitoring system described below includes a highway crash barrier positioned alongside a roadway to protect an impacting vehicle against high decelerations in the event of a collision. The crash barrier is provided with one or more collision sensors that are in turn coupled with a transmitter. The transmitter transmits a radio-frequency signal to a remote location when the collision sensor detects a condition indicative of a collision of a vehicle with the crash barrier. This radio-frequency signal is forwarded to the person or persons responsible for maintenance of the crash barrier. Typically, the crash barrier will be inspected promptly after the receipt of such a message.

Additionally, the collision sensor is coupled with a digital camera that is controlled to store one or more images in response to detection of a collision by the collision sensor. These stored images help in identifying the vehicle involved in the collision. This can be important in situations where the colliding vehicle has a responsibility to the highway department to defray expenses associated with damage to the crash barrier.

The foregoing paragraphs have been provided by way of introduction, and they are not intended to limit the scope of this invention.

DETAILED DESCRIPTION OF THE PRESENTLY PREFERRED EMBODIMENTS

Figure 1:
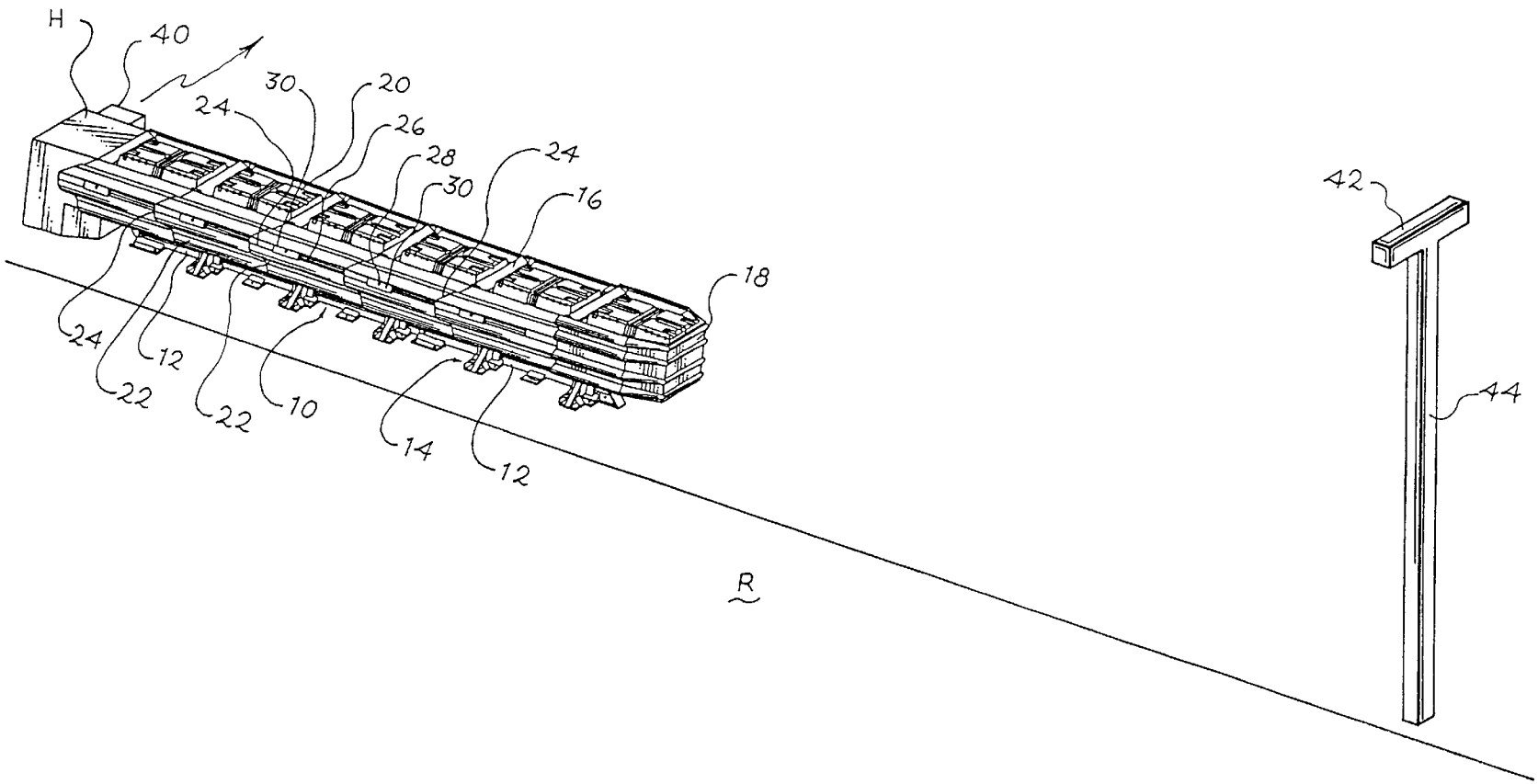
FIG. 1 is a perspective view of a highway crash barrier mounted alongside a roadway and included in a preferred embodiment of this invention.

Turning now to the drawings, FIG. 1 shows a perspective view of a crash barrier 10 installed alongside a roadway R in front of a hazard H. The crash barrier 10 in this example includes a rail 12 that supports an array of legs 14 for sliding motion along the rail 12. Each of the legs 14 supports a diaphragm 16, and energy absorbing cartridges 20 are positioned between adjacent diaphragms 16. A nose piece 18 surrounds the forward energy absorbing cartridge 20.

The diaphragms 16 support fender panels 22 extending in overlapping fashion along each side of the crash barrier 10. The forward portion of each fender panel 22 is bolted to a respective one of the diaphragms 16, and the trailing edge 24 of each fender panel 22 overlaps the leading edge of the next rearwardly-adjacent fender panel 22. Each fender panel 22 defines a longitudinal slot 26, and a fastener 28 extends through each slot 26 and is coupled at one end to a respective one of the diaphragms 16 and at the other end to a washer 30.

This arrangement allows the crash barrier 10 to telescope when a vehicle (not shown) collides with the crash barrier 10 axially. This telescoping of the crash barrier 10 brings the diaphragms 16 closer together and crushes the cartridges 20. The cartridges 20 include an energy absorbing structure that collapses in a progressive manner to reduce peak deceleration applied to the vehicle.

The crash barrier 10 is described in much greater detail in U.S. Pat. No. 5,733,062, assigned to the assignee of the present invention and hereby incorporated by reference. It should be understood that the crash barrier 10 can take many alternative forms, including those described in the following U.S. Patents, all of which are assigned to the assignee of the present invention, and all of which are hereby incorporated by reference:

- guardrail-type crash barriers (U.S. Pat. Nos. 5,797,591 and 5,967,497);
- crash barriers using friction brakes (U.S. Pat. No. 5,022,782);
- water-filled crash barriers (U.S. Pat. Nos. 4,681,302 and 5,425,594);
- crash barriers extending alongside a wall (U.S. Pat. No. 5,314,261);
- crash barriers mounted to shadow vehicles (U.S. Pat. No. 5,642,792);
- inertial crash barriers (U.S. Pat. No. 4,934,661);
- crash barriers using elastomeric energy absorbing elements (U.S. Pat. No. 5,112,028); and
- pneumatic crash barriers (U.S. Pat. No. 4,674,911).

In general, the crash barrier 10 can take any suitable form that is operative to protect a vehicle that has left a roadway when the vehicle collides with the crash barrier at highway speeds.

In addition to the conventional elements described above, the crash barrier is used in a collision monitoring system. This monitoring system includes a plurality of collision sensors (not shown in FIG. 1). In this embodiment three or more collision sensors are used, each fixed to a respective one of the diaphragms 16. The collision sensors are connected to a transmitter 40 that generates a radio frequency signal when any of the sensors 46 indicates that the crash barrier 10 has been struck by a vehicle.

The collision sensors can take many forms, depending upon the application. For example, the collision sensors may include a motion sensor, a position sensor, or an accelerometer. Motion sensors may include mercury switches or conductive spheres bridging fixed electrical contacts. Also, tape switches of the type typically used to detect breakage of a window pane are suitable in many applications. The collision sensor can interrupt an originally continuous circuit, or alternatively it can close an originally open circuit in the event of a collision.

The preferred collision sensor is responsive to acceleration of the crash barrier, and it discriminates between low-acceleration events (characteristic of road vibration for example) and high-acceleration events (characteristic of a collision of sufficient severity potentially to damage the crash barrier). For example, the collision sensor can include an accelerometer and a thresholding device that generates a collision signal in response to accelerations above the threshold and no collision signal in response to accelerations below the threshold. More simply, the collision sensor can include a conductive sphere having a rest position below at least one of a pair of spaced electrodes, such that an acceleration of a selected degree or severity is required before the conductive sphere reaches a position in which it bridges the contacts. The position of the contacts (or alternatively the rest position of the sphere) can be selected to discriminate between high-acceleration and low-acceleration events. The motion sensor distributed by Comus International (Nutley, N.J.) as mercury-free vibration sensor CW 1300-1 has been found to be suitable and can be used in the circuit of FIG. 6.

Figure 6:
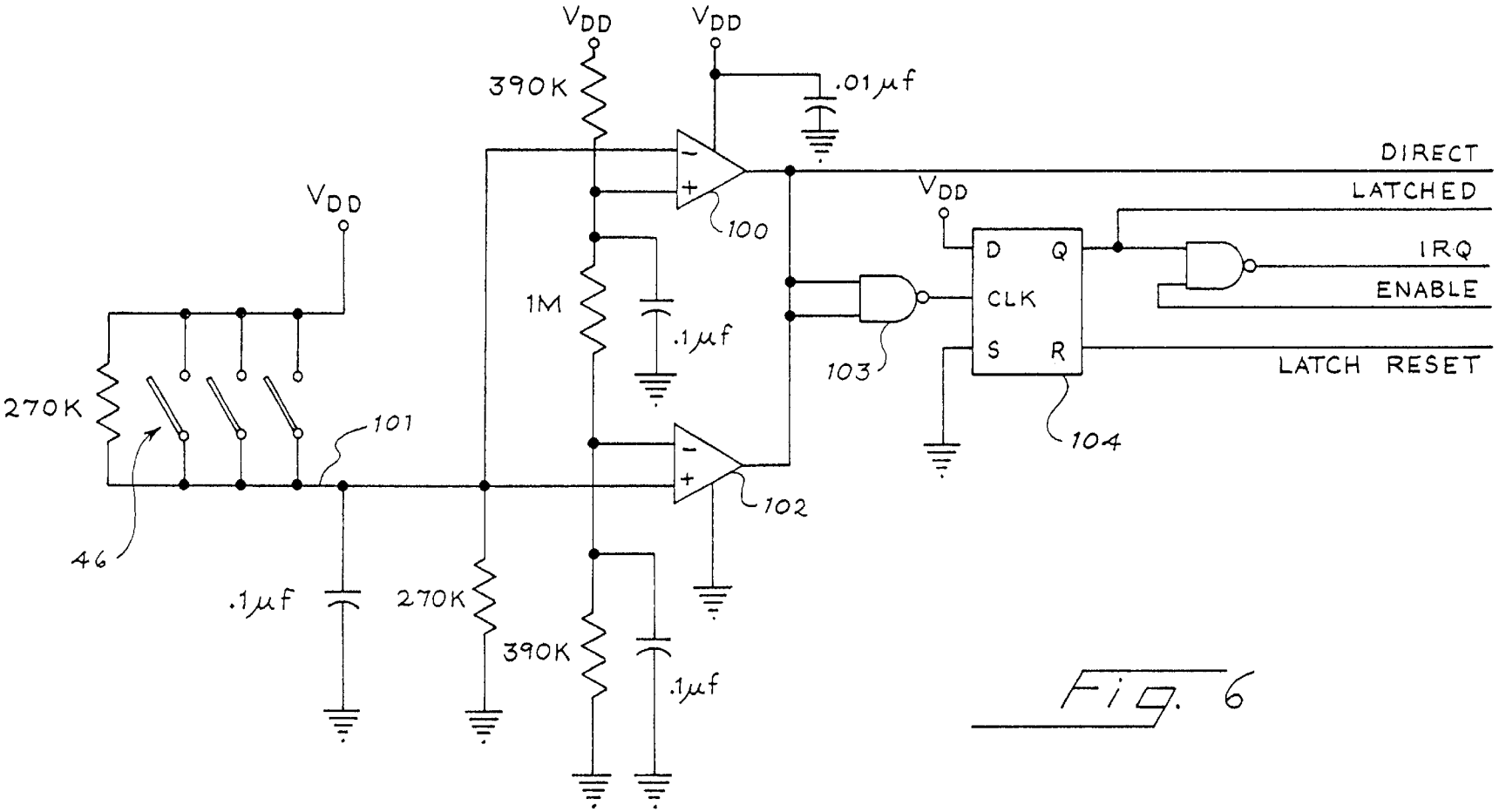
FIG. 6 is a schematic diagram of a preferred collision sensor for the system of FIG. 2.

In FIG. 6, the sensors 46 are shown as normally open switches. Prior to a collision, all of the sensors 46 are open-circuited, and the voltage on conductor 101 is approximately midway between $V_{DD}$ and ground. In this state, the outputs of both of the amplifiers 100, 102 are in the logic high state. In the event of a collision of a sufficient severity to close at least one of the collision sensor switches 46 momentarily, the voltage on the conductor 101 goes to the logic high state, which causes the output of the amplifier 100 to transition to the logic low state. This transition is clocked in the register 104, and causes an interrupt request signal to be generated. Even a momentary closure of the one of the switches 46 causes the interrupt request signal to be held indefinitely, until the latch is reset. Low-acceleration events (e.g. highway vibrations) do not cause any of the sensors 46 to close, and the output of the amplifier 100 is indicative of whether or not a high-acceleration event (e.g. a collision by a vehicle) has been detected.

The circuit of FIG. 6 also monitors for a line breakage in the circuit including the collision sensors 46. In the event of such a line breakage, the voltage on the conductor 101 falls to the logic low state. This causes the output of the amplifier 102 to fall to the logic low state, which again causes the latch 104 to issue an interrupt request signal. In this embodiment, the amplifiers 100, 102 are selected such that the inputs to the gate 103 are both pulled to the logic low state if the outputs of either of the amplifiers 100, 102 is in the logic low state. In this way, the circuit of FIG. 6 simultaneously monitors for a closure of one of the collision sensors or a broken conductor connecting the collision sensors to the amplifiers 100, 102.

As shown in FIG. 1, this system also includes a digital camera 42 that is mounted on a pole 44 alongside the roadway R. The camera 42 is positioned to obtain a clear view of the license plate of a vehicle that has struck the front of the crash barrier 10.

Figure 2:
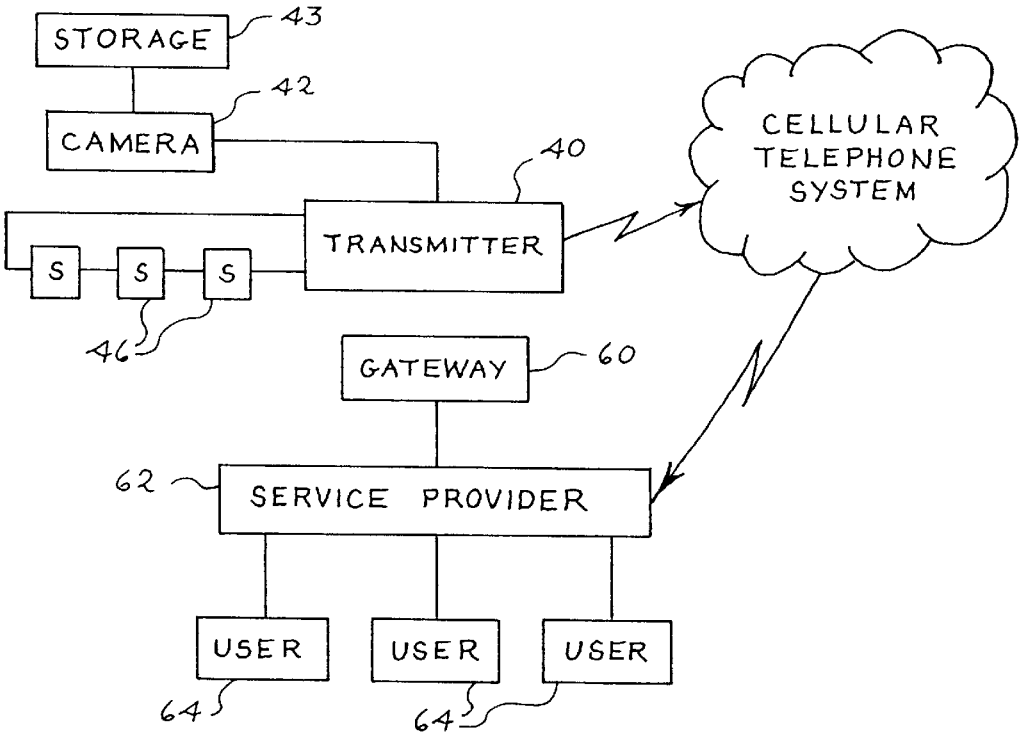
FIG. 2 is a block diagram of a monitoring system that utilizes the highway crash barrier of FIG. 1.

The overall monitoring system is shown in FIG. 2, in which the collision sensors 46 are shown connected to the transmitter 40. Similarly, the camera 42 is connected to the transmitter 40, and the camera 42 stores images on a digital storage medium 43.

In general terms, the transmitter 40 monitors the state of the collision sensors 46. When any of the collision sensors 46 senses a condition indicative of a vehicle collision with the crash barrier 10 of FIG. 1 (a "fault condition"), the transmitter 40 sends a radio fault message via a cellular telephone system to a gateway 60. The gateway 60 forwards the fault message to a service provider 62, and the service provider 62 automatically notifies a respective user 64 charged with maintenance of the crash barrier associated with the fault message. Additionally, the transmitter 40 controls the camera 42 to store one or more still frames at the time the fault message is sent.

Figure 5:
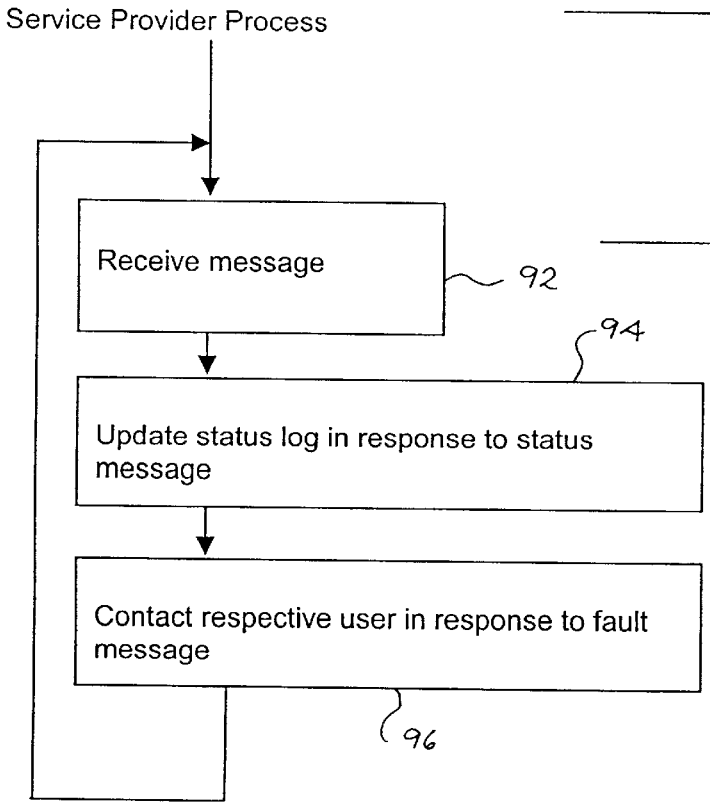
FIGS. 3, 4 and 5 are flowcharts of methods implemented by the transmitter, the gateway, and the service provider, respectively, of FIG. 2.
Figure 4:
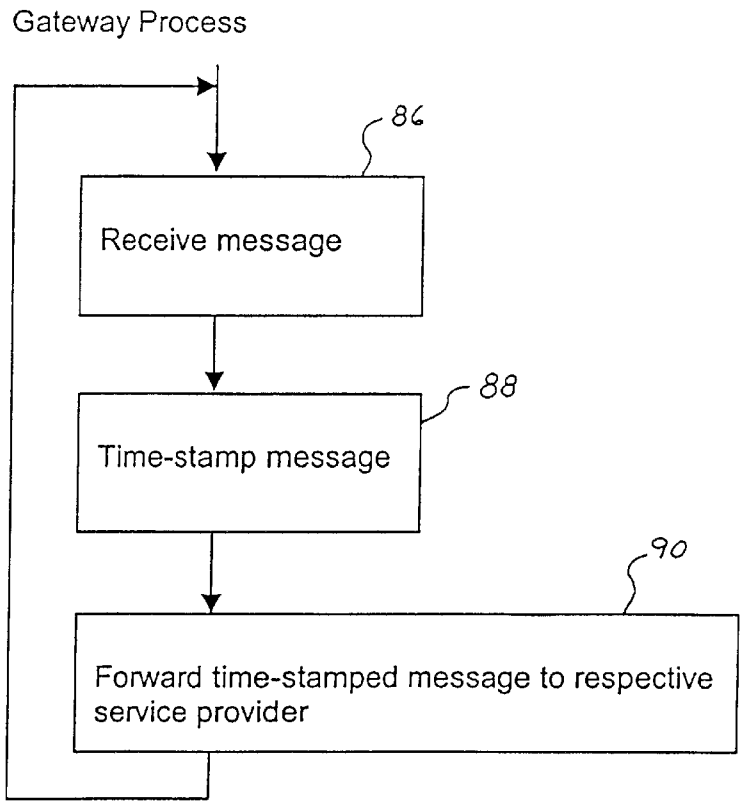
Figure 3:
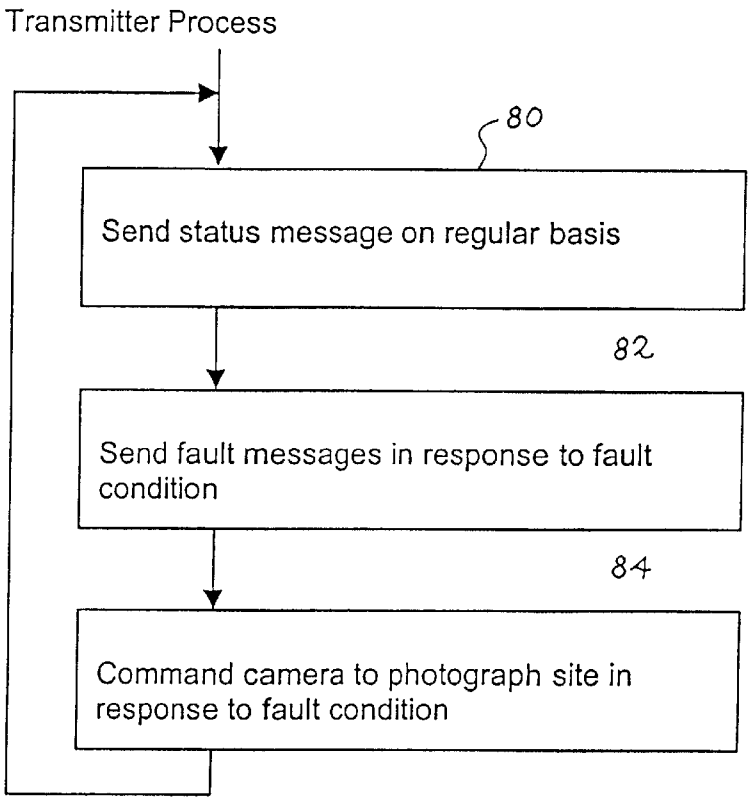

FIGS. 3 through 5 provide flowcharts of processes performed by the transmitter 40, the gateway 60, and the service provider 62.

As shown in FIGS. 2 and 3, the transmitter 40 essentially performs three acts. As shown at 80, it sends status messages on a regular basis to indicate that the transmitter 40 and the associated sensors 46 are functioning normally. Preferably, the status messages are sent at a low-usage time of day. As shown at 82, the transmitter sends a fault message in response to a fault condition. In one preferred embodiment the transmitter sends three fault messages in response to each fault condition: a first message immediately after the fault condition is detected, a second message at the next hour, and a third message at the next hour after the second message. The transmitter then attempts to reset. If the fault condition is maintained after the third fault message, the cycle repeats. As indicated at 84, the transmitter also commands the camera 42 to photograph the site in response to the fault condition. Still images taken by the camera 42 are automatically stored in the storage medium 43.

As shown in FIGS. 2 and 4, the gateway 60 receives messages at 86 from the transmitter 40, time-stamps the messages at 88 and then forwards the time-stamped messages to respective service providers 62 in block 90. Typically, there will be a large number of transmitters 40, each associated with a respective highway crash barrier. The gateway 60 forwards all of the messages associated with such transmitters to a single service provider 62. The gateway 60 may additionally handle other types of messages for other service providers (not shown).

As shown in FIGS. 2 and 5, the service provider receives messages at 92 and then updates a status log at 94 in response to status messages. In the event the messages are fault messages, the service provider 62 contacts the respective users 64, as indicated in block 96. Communication between the service provider 62 and the user 64 can be via any suitable medium, as for example telephone, fax or e-mail. Generally, the user 64 will respond to a fault message by dispatching an inspector who travels to the highway crash barrier identified in the fault message and determines if repairs or a replacement is required. At the same time, the inspector can retrieve the storage medium 43 to determine whether adequate information has been stored to allow a colliding vehicle to be identified for billing purposes.

The transmitter 40 can take many forms, and it can use any suitable technology (e.g. modem, satellite link, cellular telephone connection, or landline) to transmit fault messages to the service provider. The storage system 43 can take any suitable form, and it can include local or remote storage. In one form that is particularly simple to implement, the camera 42 stores digital images on a discrete, readily transported digital storage medium. Alternatively, the camera 42 can transmit digital images to the transmitter 40 for electronic transmission to the service provider, or the camera 42 can store photographs on film in analog form.

The communication system for transmitting messages from the transmitter 40 to the service provider 62 can also take many forms. In this preferred embodiment, the system offered by Cellemetry LLC is preferred (Cellemetry LLC, 1600 Parkwood Circle, Suite 200, Atlanta, Ga. 30329). This Cellemetry system is described at the Internet site Cellemetry.com. The transmitter 40 in this embodiment includes a Cellemetry radio that transmits a ten digit equipment ID number in place of the conventional mobile identification number (MIN) and a data payload (the above-identified fault message information) in place of the conventional electronic serial number (ESN). The cellular system directs the MIN's associated with Cellemetry radios to the Cellemetry gateway 60, and the gateway 60 uses the equipment ID (MIN) and the data payload (ESN) to transmit appropriate messages to the correct service provider 62.

The microfiche appendix provides more complete disclosure for one preferred form of the transmitter 40 suitable for use with the Cellemetry system described above, including the software that controls the microprocessor and associated hardware. In this embodiment the sensors 46 are preferably those described above in conjunction with FIG. 6.

From the foregoing, it should be apparent that the disclosed system provides users with timely information identifying crash barriers that have been struck by a colliding vehicle. This allows the users to inspect the potentially damaged crash barriers promptly, and to obtain photographic information that may assist in identifying the vehicle that has collided with the crash barrier.

As used herein, the term "coupled with" is intended broadly to encompass elements that are coupled directly as well as elements that are coupled indirectly. Thus, two elements are said to be coupled with one another whether or not intervening elements are interposed between the two coupled elements.

Of course, many changes and modifications can be made to the preferred embodiment described above. The monitoring systems described above can be applied to crash barriers such as conventional guardrails that do not include energy absorbing systems that include replaceable energy absorbing cartridges or modules. For this reason, the foregoing detailed description is intended by way of illustration only and not by way of limitation. It is only the following claims, including all equivalents, that are intended to define the scope of this invention.

What is claimed is:

1. A highway crash barrier comprising:

an energy absorbing system adapted for mounting adjacent a roadway and operative to protect a vehicle against high decelerations when the vehicle collides with the energy absorbing system at highway speeds, wherein at least a portion of the energy absorbing system is moveable in response to a vehicle colliding with the energy absorbing system;

a collision sensor mounted on and moveable with the at least said portion of said energy absorbing system that is moveable in response to the vehicle colliding with the energy absorbing structure; and a transmitter coupled with the collision sensor and operative to transmit a signal to a remote location when the collision sensor detects a condition indicative of a collision of a vehicle with the energy absorbing system.

2. The invention of claim 1 wherein the transmitter comprises a wireless telephone.

3. The invention of claim 1 wherein the transmitter comprises a radio-frequency transmitter.

4. The invention of claim 1 further comprising:

means for forwarding the transmitter signal to a user responsible for maintenance of the crash barrier.

5. The invention of claim 1 further comprising:

a camera mounted adjacent the crash barrier.

6. The invention of claim 5 further comprising:

a storage system coupled with the camera, said camera coupled with the collision sensor, and said storage system operative to store at least one image generated by the camera when the collision sensor detects a condition indicative of a collision of a vehicle with the crash barrier.

7. The invention of claim 6 further comprising:

means for forwarding the transmitter signal to a user responsible for maintenance of the crash barrier.

8. The invention of claim 6 wherein the camera is aimed to image a vehicle after the vehicle has collided with the crash barrier.

9. The invention of claim 1 wherein said collision sensor is moveable in response to low acceleration events and high acceleration events experienced by said collision sensor and said energy absorbing system, and wherein the signal transmitted by said transmitter comprises a collision signal transmitted only in response to said high acceleration events.

10. The invention of claim 9 wherein said low acceleration events comprise ambient vibrations.

11. The invention of claim 9 wherein said collision sensor comprises a variable setting for discriminating between said low acceleration events and said high acceleration events.

12. A highway crash barrier monitoring system comprising:

a crash barrier at least a portion of which is moveable in response to a vehicle colliding with the crash barrier;

a collision sensor mounted on and moveable with the at least said portion of said crash barrier that is moveable in response to the vehicle colliding with the crash barier;

a camera mounted adjacent the crash barrier and a storage system coupled with the camera;

said camera coupled with the collision sensor, and said storage system operative to store at least one image generated by the camera when the collision sensor detects a condition indicative of a collision of a vehicle with the crash barrier.

13. The invention of claim 12 wherein the camera is aimed to image a vehicle after the vehicle has collided with the crash barrier.

14. The invention of claim 12 wherein the crash barrier comprises an energy absorbing system operative to protect a vehicle against high decelerations when the vehicle collides with the energy absorbing system at highway speeds.

15. The invention of claim 12 wherein the collision sensor is responsive to movement of at least a portion of the crash barrier to generate a collision signal indicative of acceleration severity.

16. A method of detecting a collision with a highway crash barrier comprising:

mounting an energy absorbing system adjacent a roadway;

impacting said energy absorbing system with a vehicle and thereby moving at least a portion of said energy absorbing system in a high acceleration event and decelerating said vehicle with said energy absorbing system;

moving a collision sensor mounted on said at least said portion of said energy absorbing system being moved in the high acceleration event;

detecting said high acceleration event with said collision sensor; and transmitting a signal from a transmitter coupled with the collision sensor to a remote location when the collision sensor detects said high acceleration event indicative of a collision of the vehicle with the energy absorbing system.

17. The method of claim 16 further comprising capturing an image of said vehicle with a camera coupled with said collision sensor.

18. The method of claim 16 further comprising moving said at least said portion of said energy absorbing system and said collision sensor in a low acceleration event and failing to detect said low acceleration event with said collision sensor.

19. The method of claim 18 wherein said vehicle comprises a first vehicle, and wherein said moving said at least said portion of said energy absorbing system and said collision sensor in a low acceleration event comprises vibrating said energy absorbing system and said collision sensor with a second vehicle passing said energy absorbing system without impacting said energy absorbing system.

* * * * *

UNITED STATES PATENT AND TRADEMARK OFFICE

CERTIFICATE OF CORRECTION

PATENT NO. : 6,539,175 B1 
DATED : March 25, 2003
INVENTOR(S) : Jeffrey A. Geary et al.

It is certified that error appears in the above-identified patent and that said Letters Patent is hereby corrected as shown below:

Title page,
Item [75], Inventors, after "Smithfield, PA" insert -- ; Gregory L. Friend, Uniontown, PA; Terry Vincent Moore, Jr. Farmington, PA; Oca Ola Shirley, Uniontown, PA; Edward C. Nichols, Pittsburgh, PA --.

Signed and Sealed this

Ninth Day of March, 2004

JON W. DUDAS
*Acting Director of the United States Patent and Trademark Office*